US010071549B2

(12) United States Patent
Johnson

(10) Patent No.: US 10,071,549 B2
(45) **Date of Patent: *Sep. 11, 2018**

(54) PRINTHEAD POSITION CONTROL

(71) Applicant: Scott Richard Johnson, Erie, CO (US)

(72) Inventor: Scott Richard Johnson, Erie, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/059,472

(22) Filed: Mar. 3, 2016

(65) Prior Publication Data

US 2016/0250846 A1 Sep. 1, 2016

Related U.S. Application Data

(63) Continuation of application No. 14/632,698, filed on Feb. 26, 2015, now Pat. No. 9,315,055.

(51) Int. Cl.

| | |
|---|---|
| ***B41J 29/38*** | (2006.01) |
| ***B41J 2/045*** | (2006.01) |
| ***B41J 25/00*** | (2006.01) |
| ***B41J 2/21*** | (2006.01) |

(52) U.S. Cl.

CPC ..... *B41J 2/04505* (2013.01); *B41J 2/04586* (2013.01); *B41J 2/2146* (2013.01); *B41J 25/001* (2013.01)

(58) Field of Classification Search

USPC ..... 347/14, 16, 19

See application file for complete search history.

(56) References Cited

U.S. PATENT DOCUMENTS

| | | | | |
|---|---|---|---|---|
| 2012/0229550 | A1* | 9/2012 | Schluenss | B41J 2/155 347/16 |
| 2013/0201245 | A1 | 8/2013 | Donaldson | |
| 2014/0015881 | A1 | 1/2014 | Veis | |
| 2014/0063099 | A1 | 3/2014 | Enge et al. | |
| 2014/0139578 | A1 | 5/2014 | Mizes et al. | |
| 2014/0146102 | A1 | 5/2014 | Mizes et al. | |
| 2015/0290931 | A1* | 10/2015 | Boland | B41J 2/04505 347/14 |

FOREIGN PATENT DOCUMENTS

JP 2011136526 A 7/2011

OTHER PUBLICATIONS

European Search Report; EP 16 15 6034; dated May 31, 2016.
European Office Action; Application 16156034.7-1701; dated Jun. 9, 2017.

* cited by examiner

*Primary Examiner* — Lam Nguyen
(74) *Attorney, Agent, or Firm* — Duft Bornsen & Fettig LLP

(57) ABSTRACT

Systems and methods for printhead position control. The system comprises a controller that identifies a target distance for moving a printhead in a lateral direction to compensate for lateral shifts in a web of print media as the web travels in a continuous-forms printer in a conveyance direction. The controller also identifies a maximum distance for moving the printhead in the lateral direction based on an allowable print error in a color plane of the printer and one or more previous positions of the printhead. The control further moves the printhead for a distance that is a lesser of the maximum distance and the target distance.

10 Claims, 9 Drawing Sheets

| Current Position | 1st Previous Position | 2nd Previous Position | Target Position | Max distance from Current Position to any previous position in opposite direction of Target Position | Allowable Print Error | Maximum Travel Distance | Travel Distance from Current Position to Target Position | Move Distance commanded to Printhead |
|---|---|---|---|---|---|---|---|---|
| 3 | 2 | -3 | 8 | 6 | 10 | 4 | 5 | 4 |
| -2 | 2 | -3 | 6 | 1 | 10 | 9 | 8 | 8 |
| -4 | 2 | -3 | 7 | 0 | 10 | 10 | 11 | 10 |
| 3 | 4 | -3 | -14 | 1 | 10 | 9 | 17 | 9 |
| -3 | 0 | 8 | -4 | 11 | 10 | 0 | 1 | 0 |
| -3 | 0 | 5 | -3 | 8 | 10 | 2 | 0 | 0 |
| -5 | 1 | 0 | -2 | 0 | 10 | 10 | 3 | 3 |

*FIG. 6*

| Current Position | 1st Previous Position | 2nd Previous Position | Target Position | Max distance from Current Position to any previous position in opposite direction of Target Position | Allowable Print Error | Maximum Travel Distance | Travel Distance from Current Position to Target Position | Move Distance commanded to Printhead |
|---|---|---|---|---|---|---|---|---|
| 3 | 2 | -3 | 8 | 6 | 10 | 4 | 5 | 4 |
| -2 | 2 | -3 | 6 | 1 | 10 | 9 | 8 | 8 |
| -4 | 2 | -3 | 7 | 0 | 10 | 10 | 11 | 10 |
| 3 | 4 | -3 | -14 | 1 | 10 | 9 | 17 | 9 |
| -3 | 0 | 8 | -4 | 11 | 10 | 0 | 1 | 0 |
| -3 | 0 | 5 | -3 | 8 | 10 | 2 | 0 | 0 |
| -5 | 1 | 0 | -2 | 0 | 10 | 10 | 3 | 3 |

*FIG. 8*

| Time (sec) | Web Speed (mm/sec) | Target Position (μm) | Output Position of Filter 1 (μm) | Output Position of Filter 2 (μm) | Output Position of Combined Filters (μm) | Error of Combined Filter (μm) | Velocity Limit Position (μm) | Error of Velocity Limit Position (μm) |
|---|---|---|---|---|---|---|---|---|
| 0 | 1000 | 3.835404309 | 3.835404309 | 3.835404309 | 3.835404309 | 0 | 3.835404309 | 0 |
| 0.01 | 1000 | 8.695021244 | 8.695021244 | 8.695021244 | 8.695021244 | 0 | 6.335404309 | 2.359616936 |
| 0.02 | 998 | 10.7272188 | 10.7272188 | 10.7272188 | 10.7272188 | 0 | 8.835404309 | 1.891814488 |
| 0.03 | 997 | 9.626699678 | 9.626699678 | 9.626699678 | 9.626699678 | 0 | 9.626699678 | 0 |
| 0.04 | 998 | 6.239872457 | 6.239872457 | 6.239872457 | 6.239872457 | 0 | 7.126699678 | 0.88682722 |
| 0.05 | 999 | 2.221117589 | 2.221117589 | 2.221117589 | 2.221117589 | 0 | 4.626699678 | 2.405582088 |
| 0.06 | 1000 | -0.617234531 | -0.373300322 | -0.617234531 | -0.373300322 | 0.243934209 | 2.126699678 | 2.743934209 |
| 0.07 | 1001 | -1.012280551 | -1.012280551 | -1.012280551 | -1.012280551 | 0 | -0.373300322 | 0.638980229 |
| 0.08 | 1002 | 1.25545895 | 1.25545895 | 1.25545895 | 1.25545895 | 0 | 1.25545895 | 0 |
| 0.09 | 1003 | 5.2705292 | 5.2705292 | 5.2705292 | 5.2705292 | 0 | 3.75545895 | 1.51507025 |
| 0.1 | 1002 | 9.328748545 | 8.987719449 | 9.328748545 | 8.987719449 | 0.341029096 | 6.25545895 | 3.073289595 |
| 0.11 | 1001 | 11.5890218 | 11.25545895 | 11.5890218 | 11.25545895 | 0.333562853 | 8.75545895 | 2.833562853 |
| 0.12 | 1000 | 10.78176327 | 10.78176327 | 10.78176327 | 10.78176327 | 0 | 10.78176327 | 0 |
| 0.13 | 999 | 6.70315712 | 6.70315712 | 6.70315712 | 6.70315712 | 0 | 8.281763267 | 1.578606147 |
| 0.14 | 998 | 0.306139385 | 1.25545895 | 0.306139385 | 1.25545895 | 0.949319565 | 5.781763267 | 5.475623882 |
| 0.15 | 997 | -6.647110862 | 0.781763267 | -6.647110862 | 0.781763267 | 7.428874129 | 3.281763267 | 9.928874129 |
| 0.16 | 998 | -12.23901339 | -3.29684288 | -12.23901339 | -3.29684288 | 8.942170514 | 0.781763267 | 13.02077666 |
| 0.17 | 999 | -15.10769362 | -8.74454105 | -13.4109782 | -8.74454105 | 6.363152575 | -1.718236733 | 13.38945689 |
| 0.18 | 1000 | -14.94448701 | -9.218236733 | -13.4109782 | -9.218236733 | 5.726250274 | -4.218236733 | 10.72625027 |
| 0.19 | 1001 | -12.58861026 | -12.58861026 | -12.58861026 | -12.58861026 | 0 | -6.718236733 | 5.870373529 |
| 0.2 | 1002 | -9.683656494 | -9.683656494 | -9.683656494 | -9.683656494 | 0 | -9.218236733 | 0.465419761 |

PRINTHEAD POSITION CONTROL

RELATED APPLICATIONS

This document is a continuation of co-pending U.S. patent application Ser. No. 14/632,698 (filed on Feb. 26, 2015) titled, "PRINTHEAD POSITION CONTROL," which is hereby incorporated by reference.

FIELD OF THE INVENTION

The invention relates to the field of printing systems, and in particular, to positional control of printheads in continuous-forms printing systems.

BACKGROUND

Entities with substantial printing demands often use a production printer such as a continuous-forms printer that prints on a web of print media at high-speed. A production printer typically includes a print controller that controls the overall operation of the printing system, and a print engine that physically marks the web. The print engine has one or more printheads each with rows of small nozzles that discharge ink as controlled by the printhead controller.

While printing, the web is quickly passed underneath the nozzles, which discharge ink at intervals to form pixels on the web. The web may shift laterally with respect to its direction of travel due to a variety of factors such as the physical properties of the web, amount of ink applied to the web, environmental conditions within the printer, positioning of rollers, etc. When these lateral shifts occur during printing, the printed output for a print job may also be shifted. Even relatively small lateral shifts may result in reduced print quality.

When multiple printheads are used by a printer to form a mixed color pixel, a small fluctuation in web position can cause an upstream printhead to mark the correct physical location, while a downstream printhead marks the wrong physical location. Thus, to maintain color-to-color registration between printheads, a positioning system may quickly adjust the lateral position of the downstream printhead. However, if the printhead is adjusted too quickly (e.g., too much distance in a time period), nozzles within the printhead may mark the wrong physical location with respect to other nozzles in the printhead, resulting in misalignment in the color plane and reduced print quality.

SUMMARY

Embodiments described herein provide for printhead position control. When printheads are moved to align with respect to one another to correct for web deviations during printing (e.g., for color-to-color registration), one or more printheads may be moved too quickly (e.g., too much distance in a period of time) such that its nozzles print in an undesirable location with respect to other nozzles in the color plane. Therefore, printhead movement may be controlled to balance the interest of maintaining output alignment between different color planes with the competing interest of maintaining output alignment within a single color plane.

One embodiment is an apparatus that includes a controller that identifies a target distance for moving a printhead in a lateral direction to compensate for lateral shifts in a web of print media as the web travels in a continuous-forms printer in a conveyance direction. The controller also identifies a maximum distance for moving the printhead in the lateral direction based on an allowable print error in a color plane of the printer and one or more previous positions of the printhead. The control further moves the printhead for a distance that is a lesser of the maximum distance and the target distance.

The above summary provides a basic understanding of some aspects of the specification. This summary is not an extensive overview of the specification. It is not intended to identify key or critical elements of the specification nor to delineate any scope of particular embodiments of the specification, or any scope of the claims. Its sole purpose is to present some concepts of the specification in a simplified form as a prelude to the more detailed description that is presented later. Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

FIG. 6 is a table illustrating exemplary values for controlling a position of a printhead based on previous positions of the printhead.

FIG. 8 is a table illustrating exemplary values for controlling a position of a printhead with multiple allowable print error distances.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
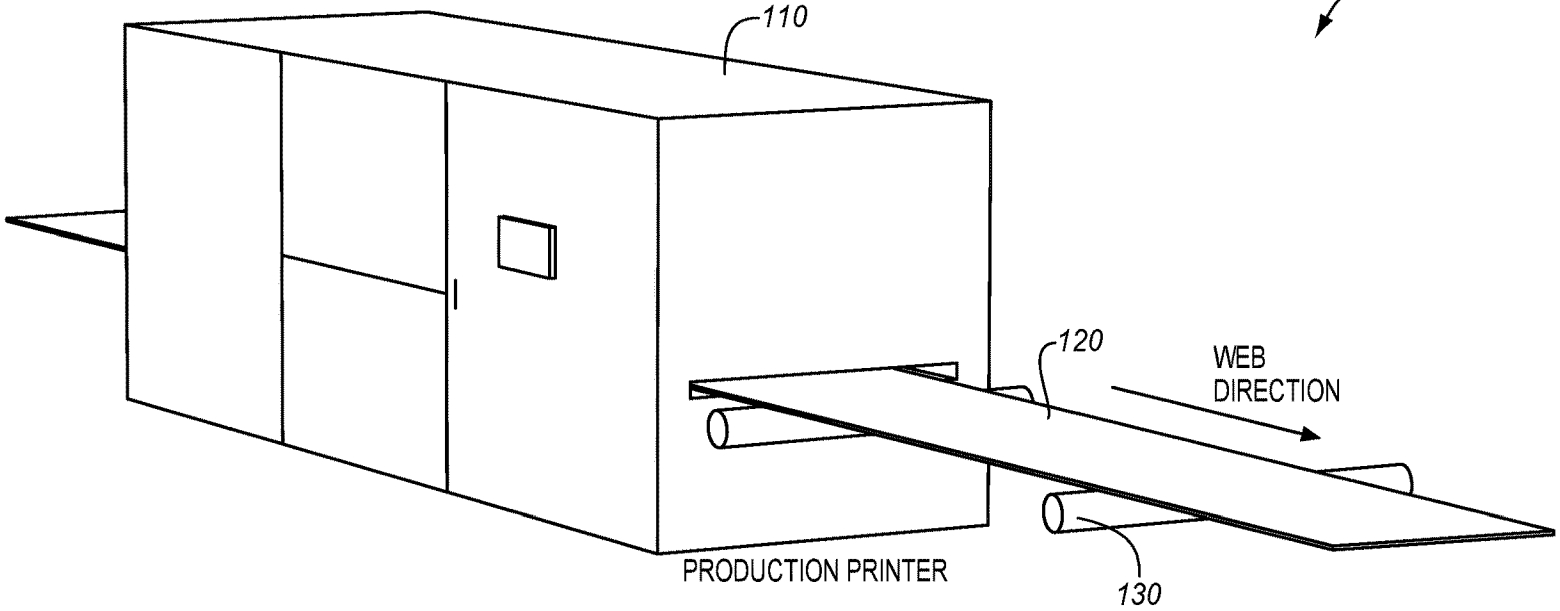
FIG. 1 illustrates an exemplary continuous-forms printing system.

FIG. 1 illustrates an exemplary continuous-forms printing system 100. Printing system 100 includes production printer 110, which is operable to apply ink onto a web 120 of continuous-form print media (e.g., paper). As used herein, the word "ink" is used to refer to any suitable marking fluid (e.g., aqueous inks, oil-based paints, additive manufacturing materials, etc.). Printer 110 may comprise an inkjet printer that applies colored inks, such as Cyan (C), Magenta (M), Yellow (Y), and Key (K) black inks. One or more rollers 130 position and tension web 120 as it travels through printing system 100.

Figure 2:
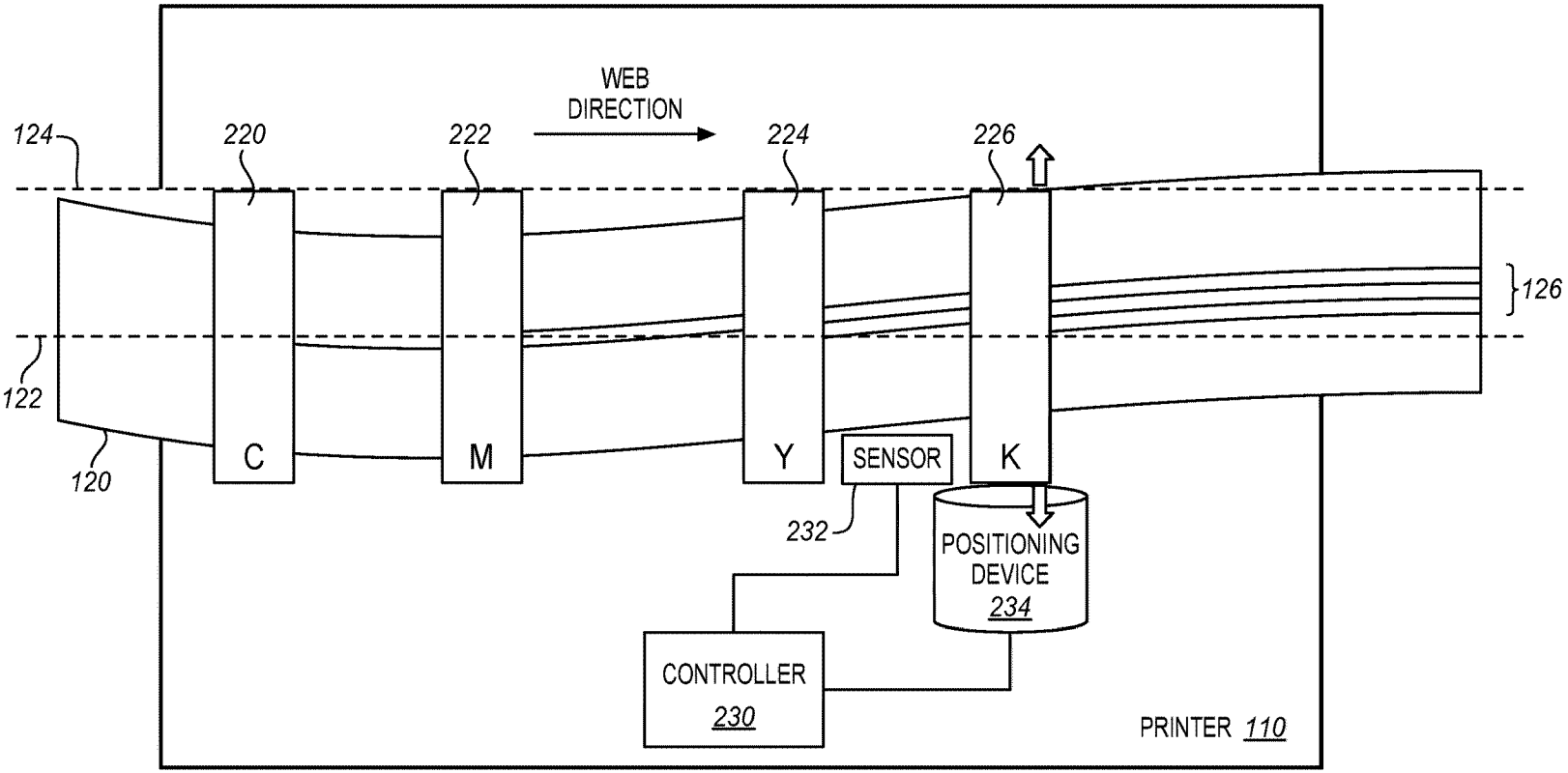
FIG. 2 is a block diagram illustrating a printing system with multiple color planes that accounts for lateral shifts at a web of print media in an exemplary embodiment.

FIG. 2 illustrates a production printer 110 with multiple color planes that accounts for lateral shifts at a web of print media in an exemplary embodiment. Printer 110 includes one or more printheads 220-226 to mark ink onto web 120. In this case, each printhead 220-226 acts as a color plane for one of cyan, magenta, yellow, and key black. FIG. 2 shows each printhead 220-226 aligned in the same position relative to its peers, as indicated by reference lines 122 and 124. When printheads 220-226 are aligned in this manner, they mark the same lateral position with respect to each other. Unfortunately, if the position of web 120 fluctuates in between stationary printheads, the distance of printed marks relative to the edge of the paper will vary as the edge of the paper itself varies as illustrated by element 126. In other words, color-to-color misregistration occurs even though each printhead 220-226 marks the exact same lateral position with respect to its peers.

To maintain color-to-color registration between color planes, printer 110 is configured to adjust the lateral position of one or more printheads. A lateral change in the position of a printhead is substantially orthogonal to the direction of travel, or conveyance direction of web 120. In this example, printer 110 includes a printhead positioning system for printhead 226, which is an apparatus comprised of a controller 230, sensor 232, and positioning device 234. Though a particular arrangement of a positioning system is illustrated and described for one printhead for sake of brevity, other arrangements and configurations of positioning systems and printhead(s) are possible.

Sensor 232 comprises any system, component, device, or apparatus operable to detect positional shifts in the web. For example, sensor 232 may comprise a laser, pneumatic, photoelectric, ultrasonic, infrared, optical, or any other suitable type of sensing device. Sensor 340 is placed upstream of printhead 226 with respect to the direction of travel of the web during printing and detects the lateral position of the web before it reaches printhead 226.

Controller 230 comprises any system, component, device, or apparatus operable to control the position of printhead 226 based on changes in lateral position detected by sensor 232, or by a system of sensors. Controller 230 directs positioning device 234 to physically move the lateral position of printhead 226 as shown by the arrows in FIG. 2 during printing to compensate for the changing position of web 120 during printing. Positioning device 234 may comprise a linear actuator, a movable printhead assembly that can reposition itself by driving itself along a fixed rail, or any other suitable system capable of moving printhead 226. Positioning device 234 may additionally comprise a position sensor operable to determine lateral positioning of the printhead.

To achieve high volume printing, web 120 may pass underneath printheads 220-226 at a high rate of speed. Furthermore, the distance between printheads 220-226 is relatively small and therefore there is a correspondingly small amount of time to correctly position printhead 226 over web 120 to compensate for a lateral shift in web 120. Controller 230 may thus direct position device 234 to move printhead 226 quickly into position. However, print quality may degrade if printhead 226 is moved too quickly.

Figure 3:
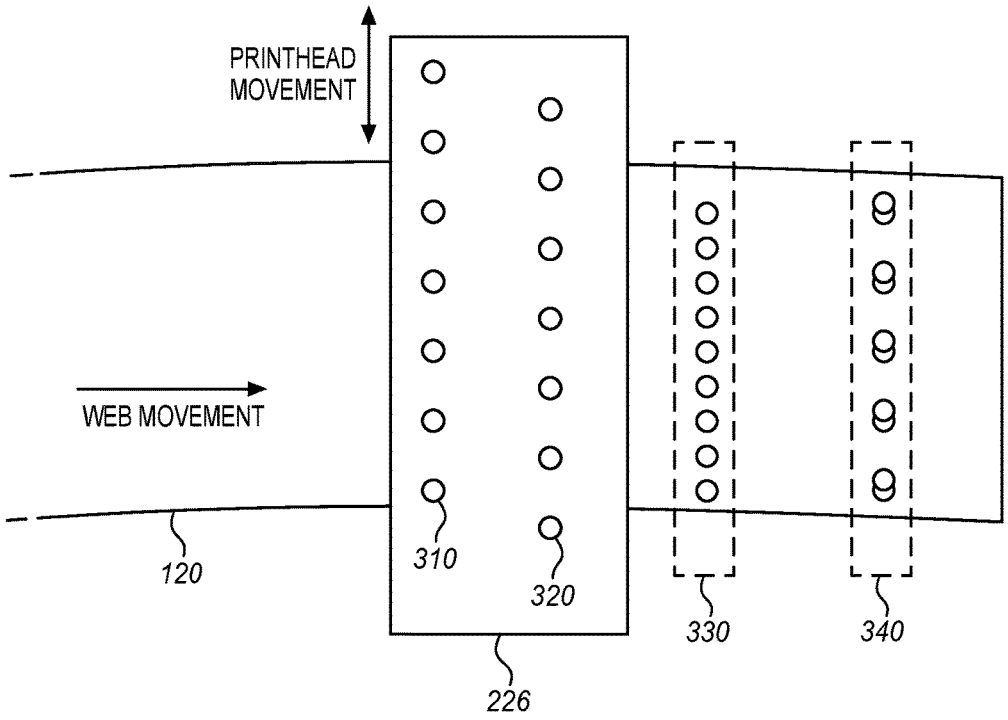
FIG. 3 is a diagram illustrating a printhead being positioned over a web of print media in an exemplary embodiment.

FIG. 3 is a diagram illustrating an exemplary printhead being positioned over a web of print media. FIG. 3 helps to illustrate potential problems with moving a printhead too quickly. In FIG. 3, printhead 226 is comprised of multiple rows of nozzles, 310 and 320. Each row is located at a different location with respect to the direction of travel of the web. After printing, the ink from the rows of nozzles should be evenly distributed, as shown by element 330. However, if printhead 226 is moved too quickly across the web, row 320 of the printhead may print at a different location than intended relative to row 310. Even though the output from the rows is intended to be evenly distributed, as shown by element 330, the output appears jittery as shown by element 340. In other words, in the course of continual adjustment a printhead for color-to-color registration, the movement of the printhead at some points of time may be substantial such that nozzle rows (e.g., row 310 and 320) of the printhead mark a different lateral position on the web than intended, resulting in degraded output within a single color plane as shown in element 340.

Figure 4:
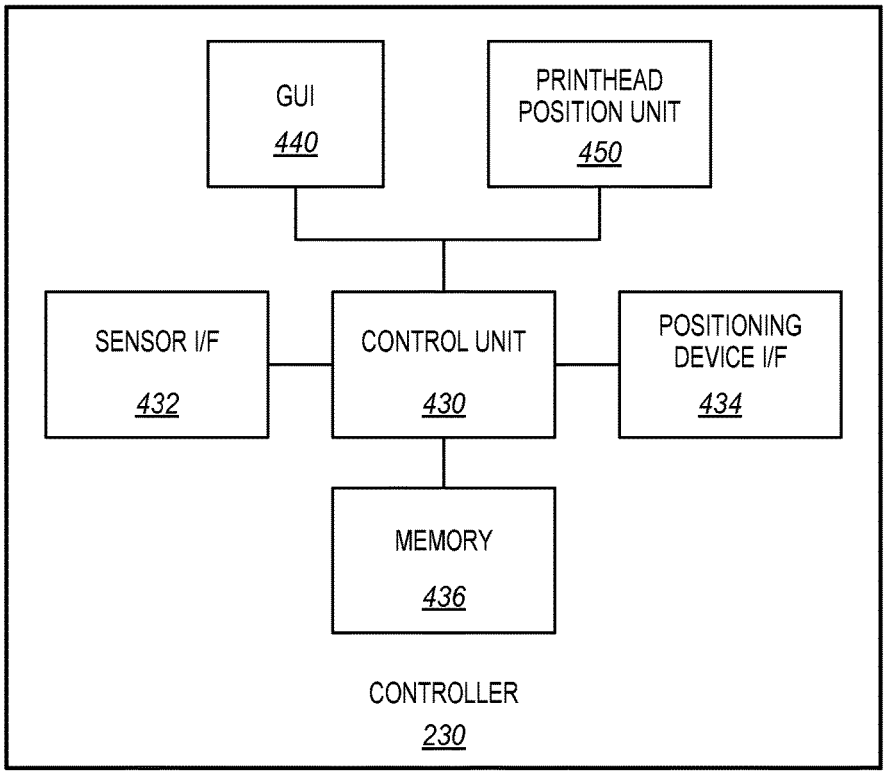
FIG. 4 is a block diagram of a controller with a printhead position unit in an exemplary embodiment.

Controller 230 is therefore enhanced with a printhead position unit that is operable to control the movement of printheads. FIG. 4 illustrates a controller with a printhead position unit in an exemplary embodiment. Controller 230 includes a control unit 430, a sensor interface 432, a positioning device interface 434, memory 436, a graphical user interface (GUI) 440, and a printhead position unit 450.

Control unit 430 controls the overall operation of controller 230 and implements a printhead positioning feedback system similar to that already described above via any suitable communication medium with sensor interface 432 and/or positioning device interface 434. Control unit 430 may also receive input from a user/operator via GUI 440 related to positional limits of one or more printheads and store data related to the input in memory 436. For example, an operator may observe a reduced print quality resulting from aggressive color-to-color registration correction (resulting in misalignment within a single color plane as shown in element 340 of FIG. 3) and provide values to printhead position unit 450 to use in controlling the movement of the printheads.

Printhead position unit 450 is any system, component, device, or apparatus operable to identify positional limits for one or more printheads in the printer. Printhead position unit 450 implements logic or an algorithm to calculate an optimal balance between color-to-color registration and color plane registration using one or more variables. Examples of variables include, but are not limited to, web velocity, printhead configuration/geometry, nozzle configuration/geometry, positioning system configuration/geometry, user input thresholds, etc. Printhead position unit 450 may direct control unit 430 to modify the next commanded position of one or more printheads when the target position based on the positioning feedback system may result in misalignment within a color plane.

In one embodiment, printhead position unit 450 implements a velocity limit on one or more printheads in the printing system. The velocity limit may be received by user input or calculated based one or more variables described above. In another embodiment, printhead position unit 450 implements a stepwise position control approach. For instance, printhead position unit 450 may continually poll sensors, determine a target position of a printhead at each point, and drive the printhead to a position that may be limited based on one or more variables described above. Illustrative details of the operation of controller 230 and/or printhead position unit 450 will be discussed with regard to FIG. 5.

Figure 5:
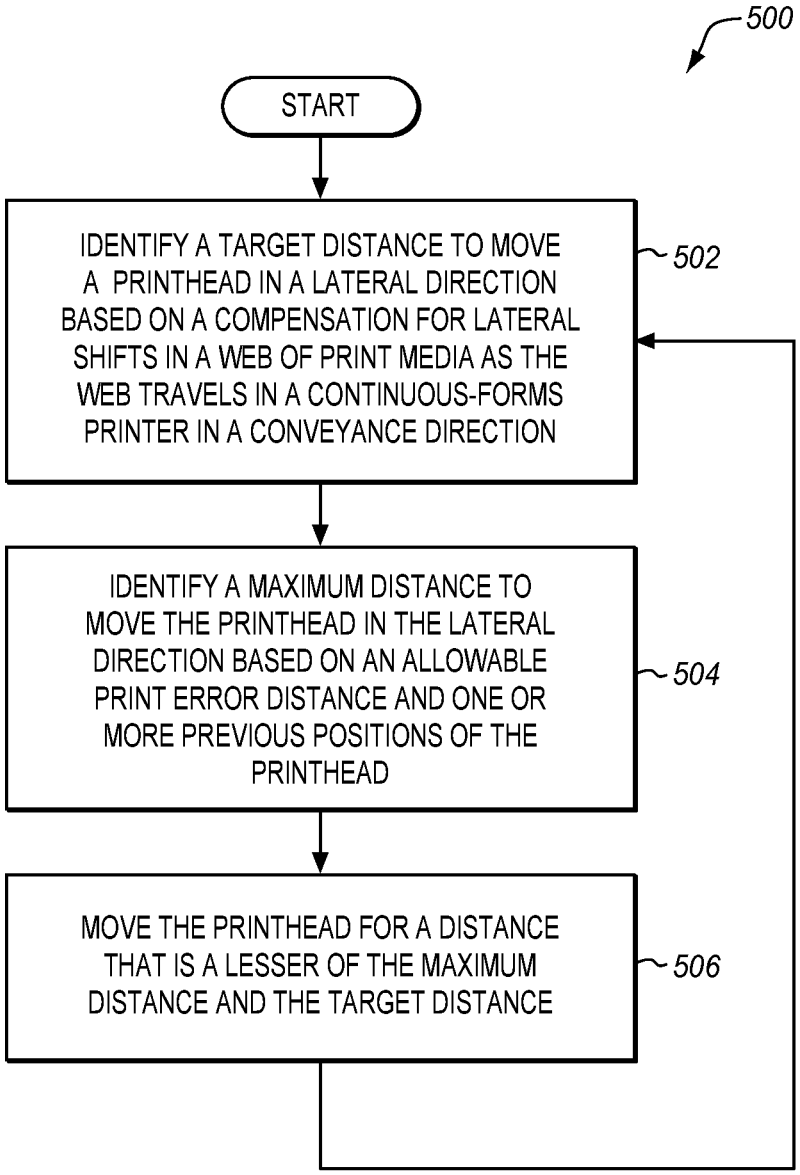
FIG. 5 is a flowchart illustrating a method of controlling a position of a printhead in an exemplary embodiment.

FIG. 5 is a flowchart illustrating a method of controlling the position of a printhead in an exemplary embodiment. Assume, for this embodiment, that printer 110 has started printing, and that during printing the web is being driven underneath printhead 226. Further, assume that the lateral position of the web is shifting slightly back and forth due to the web being driven or other environmental factors.

The steps of method 500 are described with reference to printhead position unit 450, controller 230, printhead 226, and printer 110, but those skilled in the art will appreciate that method 500 may be performed with other systems, printers, printheads, etc. The steps of the flowcharts described herein are not all inclusive and may include other steps not shown. The steps described herein may also be performed in an alternative order.

In step 502, controller 230 identifies a target distance to move printhead 226 in a lateral direction based on a compensation for lateral shifts of web 120 as it travels in printer 110. Sensor 232 may detect changes in the lateral position of web 120 and report these changes to controller 230 over sensor interface 432. Positioning device 234 may report current positions of printhead 226 to controller 230 over positioning device interface 434. Controller 230 may store position(s) of printhead 226 in memory 436.

Controller 230 may use printhead position unit 450 to analyze a target position of printhead 226 with respect to a current or previous position(s) of printhead 226 before taking action to move printhead 226. For instance, controller 230 (or printhead position unit 450) may determine the target distance by identifying a target position of printhead 226 as indicated by the sensor feedback system and subtracting a current position of printhead 226. The target position of printhead 226 may comprise the position where printhead 226 is to be moved for color-to-color registration without regard to registration within a single color plane. In other words, the target position may be based on lateral shifts of web 120 detected by sensor feedback.

In step 504, printhead position unit 450 identifies a maximum distance to move printhead 226 in the lateral direction based on an allowable print error distance and one or more previous positions of the printhead. The allowable print error distance indicates an allowable amount of ink drop placement error within a color plane. The allowable print error distance may be input by a user over GUI 440 and stored in memory 436 and/or printhead position unit 450 may calculate the allowable print error distance based variables of the print system. As will be described in more detail below, printhead position unit 450 may analyze the allowable print error distance with respect to previous positions of printhead 226 to determine whether to limit the next commanded position of printhead 226.

In step 506, printhead position unit 450 moves printhead 226 for a distance that is a lesser of the maximum distance and the target distance. In either case, the distance for which printhead 226 is moved is generally in a direction toward the target position as indicated by sensor feedback. Thus, printhead position unit 450 may limit, or instruct controller 230 to limit, the positional movement of printhead 226 when the next movement may result in misaligned output within a single color plane farther than the allowable print error distance.

As will be described in additional detail in the examples below, the stepwise positional control implemented in method 500 may provide an optimal balance between alignment between color planes and alignment of a single color plane. As shown in FIG. 5, method 500 may iteratively repeat during printing to continuously determine a next commanded position of printhead 226 for balancing color-to-color registration and color plane registration.

In one embodiment, printhead position unit 450 identifies a previous position of the printhead that is furthest from a current position of the printhead and in a direction opposite to a direction of a target position of the target distance, determines a value that represents a distance between the previous position and the current position, determines a difference between the allowable print error and the value, and identifies the maximum distance for moving the printhead based on the difference. In other words, printhead position unit 450 may determine the maximum distance to move printhead 226 using the maximum value of distance (e.g., absolute value) from the current printhead position to any selected previous position that is in the direction opposite of the target position of printhead 226 as indicated by the sensor feedback system. Printhead position unit 450 may then subtract the maximum value from the allowable print error to yield the maximum distance for moving printhead 226. If the result of the subtraction is negative, printhead position unit 450 may set the maximum distance to zero. Printhead position unit 450 may determine/select a number of previous positions of printhead to be analyzed/compared with a current position of the printhead based on, for example, web speed, sensor sample rate, a period of time, printer/printhead geometries, user input, etc.

In another embodiment, printhead position unit 450 identifies the maximum distance to move the printhead based on one or multiple allowable print error distances related to the printer and/or printhead geometry. For instance, if a printhead includes multiple nozzle rows and the printer uses multiple printheads for a color plane, printhead position unit 450 may calculate the maximum distance to move a printhead based on a first allowable print error distance between nozzles rows of the same printhead and a second allowable print error distance between printheads of the same color plane. Alternatively or additionally, multiple allowable print error distances may represent different distances between several nozzle rows of the same printhead. Distances related to configuration and/or geometry of printer, color plane, printheads, nozzles, etc. and may be input by a user over GUI 440 and stored in memory 436.

Additionally or alternatively, printhead position unit 450 may determine the maximum distance to move a printhead based on other variables, including but not limited to, web speed, a period of time, sensor sample rate, or user input thresholds. For instance, printhead position unit 450 may calculate the maximum distance using one or more multiple sets of criteria, or filters, that printhead position unit 450 uses to modify the positional output of printhead 226 to improve registration within the color plane of printhead 226. Printhead position unit 450 may command the next movement of the printhead according to the set of criteria that is more restrictive to the movement of the printhead. This provides flexibility for balancing registration error both within a single color plane and between color planes.

EXAMPLES

In the following examples, additional processes, systems, and methods are described in the context of a printing system with printhead position control. FIG. 6 is a table illustrating exemplary values (e.g., positions/distances in microns) for controlling a position of a printhead based on previous positions of the printhead.

If a user does not input data for controlling printhead position or control unit 430 otherwise does not implement the functionality of printhead position unit 450, control unit 430 may move printhead 226 in accordance with lateral deviations of web 120 as determined by sensor feedback to maintain color-to-color registration as illustrated by the Target Position column in FIG. 6.

Assume, for the example of FIG. 6, that a user has input 10 μm as an allowable print error between nozzle rows of a printhead and that each movement considers the previous two positions of the printhead. Taking the first row of FIG. 6 as an example point for sake of discussion, assume that a current position of the printhead is 3 μm (e.g., shifted in the lateral direction to one side with respect to a neutral position) and that the immediate previous positions of the printhead were 2 μm and −3 μm (e.g., shifted to the lateral direction to the opposite side with respect to a neutral position).

In this instance, because the second previous position of the printhead (i.e., −3 μm) is in the opposite direction of the target position (i.e., 8 μm), the maximum value of a distance from the current position to any previous position in the opposite direction of the target position is 6 μm (e.g., difference between current position of 3 μm and a previous position of −3 μm). Printhead position unit 450 therefore determines a maximum distance to move the printhead of 4 μm by taking the difference between the allowable print error of 10 μm and the maximum value of a distance between current and previous positions of the printhead of 6 μm. Because the difference between the target position from the current position is 5 μm in this instance, printhead position unit 450 instructs the printhead to move 4 μm toward the target position since the maximum travel distance is the lesser.

However, as shown in the next row, printhead position unit 450 may instruct printhead to move from the current position to the target position when the distance between the target position and the current position is smaller than the difference between the allowable print error and the maximum value between a current a position and a previous position of the printhead in an opposite direction to that of the target position (e.g., 8 μm is less than 9 μm as shown in the second row of FIG. 6).

Moreover, as shown in the third row of FIG. 6, when no previous position is in the opposite direction of the target position, printhead position unit 450 may set the maximum distance between a current position and any previous position to zero. Additionally, as shown in the fifth row of FIG. 6, printhead position unit 450 may set the maximum distance to zero if the subtraction of the value (i.e., the max distance from the current position to any previous position in the opposite direction of the target position) from the allowable print error results in a negative number.

As illustrated by the values in FIG. 6, the next commanded position of the printhead may be limited if the target distance to move the print head is too large with respect to an allowable print error and one or more previous positions of the printhead. Nonetheless, printhead position unit 450 may still allow the printhead to move to the target position when the target distance is not too large so that color-to-color registration is maintained to the fullest extent possible. It will be appreciated that such flexibility enables a user to balance color-to-color registration and color plane registration to a customized preference.

Figure 7:
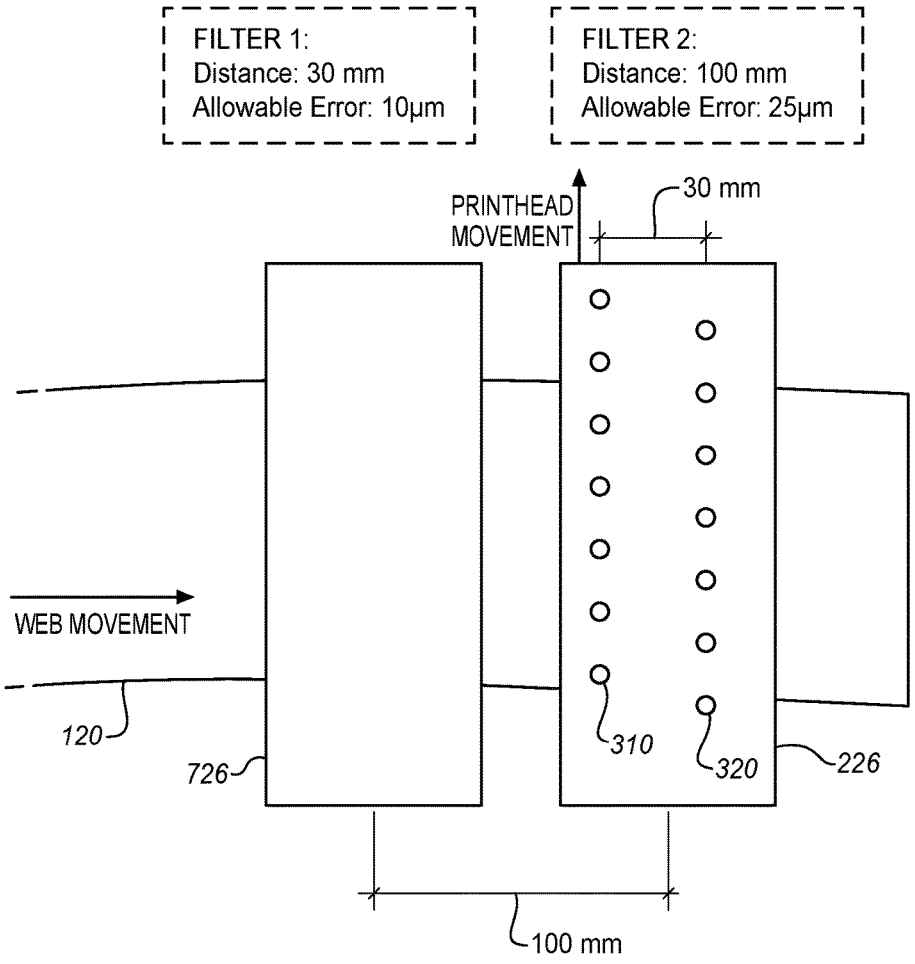
FIG. 7 is a diagram illustrating a printhead being positioned over a web of print media in an exemplary embodiment.

FIG. 7 is a diagram illustrating a printhead being positioned over a web of print media in an exemplary embodiment. Here, printhead 226 includes multiple rows of nozzles (e.g., row 310 and 320) spaced 30 mm apart. Additionally, printhead 726 is within the same color plane as printhead 226 and is spaced 100 mm upstream.

In this example, printhead control unit 450 implements two filters, Filter 1 and Filter 2, to potentially limit movements of printhead 226 at specific times. Filter 1 improves color plane alignment related to nozzles within printhead 226 and Filter 2 improves color plane alignment related to printheads within the same color plane (e.g., Cyan). For this example, assume that a user has input an allowable print error between nozzles of 10 μm for Filter 1 and has further input an allowable print error between printheads of 25 μm for Filter 2.

FIG. 8 is a table illustrating exemplary values for controlling positions of a printhead using the printhead geometry and filter values of FIG. 7. While a job is being printed, web 120 travels through the printing system at a rate of approximately 1,000 mm/sec with slight variations. FIG. 8 shows a table of values related to the position of printhead 226 from time 0 to time 0.2. As web 120 moves, its lateral position fluctuates back and forth. If a user does not input data for controlling printhead position or control unit 430 otherwise does not implement the functionality of printhead position unit 450, control unit 430 may move printhead 226 in accordance with lateral deviations of web 120 as determined by sensor feedback to maintain color-to-color registration as illustrated by the Target Position column in FIG. 8. However, as described previously, while movement of printhead 226 in accordance with target positions of sensor feedback maintains correct color-to-color registration, it may at times undesirably produce misalignment within a single color plane when color-to-color registration movement is substantial.

Therefore, a user may input positional limits on printhead 226 as described above with respect to Filter 1 and Filter 2. The Output Position of Filter 1 column shows the positions of printhead 226 over time if criteria related to nozzles within printhead 226 are maintained. Similarly, the Output Position of Filter 2 column shows the positions of printhead 226 over time if criteria related to the upstream printhead and printhead 226 of the same color plane is maintained.

Thus, for Filter 1, printhead position unit 450 prevents the next commanded position from being more than 10 μm different from any position commanded for the previous 30 mm of web movement. Since the sample rate of the sensors is 0.01 seconds and the web speed is approximately 1,000 mm/sec, printhead position unit 450 prevents the next commanded position from being more than 10 μm from the previous three data points (i.e., positions). As discussed previously, previous positions of web 120 may be stored in memory 436.

Similarly, for Filter 2, printhead position unit 450 prevents the next commanded position from being more than 25 μm different from any position commanded for the previous 100 mm of web movement. Given the sample rate and speed of the web, printhead position unit 450 prevents the next commanded position from being more than 25 μm from the previous ten positions of printhead 226.

Printhead position control 450 may implement as many filters/criteria as necessary to maintain color plane registration and values may be adjusted according to user preference. Each filter/criteria may have different settings (e.g., allowable print error or periods of time) corresponding to the desired output response for the targeted nozzles or printheads. For this example, the Output Position of Combined Filters column shows how multiple geometry criteria may be used to define the output position. For instance, at time 0.06, the criteria of Filter 1 limits the movement of printhead 226 while the criteria of Filter 2 does not. At time 0.17, the criteria of Filter 1 and Filter 2 limit the movement of printhead 226 and printhead position control 450 uses the criteria of Filter 1 for the combined output since its criteria is more restrictive in this instance. Alternatively, although not shown in FIG. 8, there may be a case that the criteria of Filter 2 limits the movement of printhead 226 while the criteria of Filter 1 does not if Filter 2 criteria is more restrictive.

The Error of Combined Filter column represents the color-to-color registration error incurred by implementing Filter 1 and Filter 2. In other words, this column shows the difference between the Target Output Position and the Output Position of Combined Filters. Here, though within-color drop placement error is improved by the criteria of Filters 1 and 2, error in color-to-color registration is incurred as a result at times 0.06, 0.1-0.11, and 0.14-0.18. The mean average error of the combined filters is 1.516 μm with a maximum error of 8.94 μm.

By comparison, consider if position control unit 450 implements a single velocity threshold for printhead 226. The Velocity Limit Position column shows the position output of printhead 226 if the criteria of the filters were used to set a single velocity limit. In this example, Filter 2 imposes a more restrictive velocity limit since the slope of 25 μm over 100 mm is smaller than the slope of 10 μm over 30 mm. Thus, the Velocity Limit Position column shows movement of printhead 226 if printhead position control 450 prevented the next commanded position from being more than 2.5 μm from the previous position of printhead 226.

The Error of Velocity Position column represents the color-to-color registration error incurred by implementing a single velocity limit on printhead 226 (i.e., the difference between the Target Output Position and the Velocity Limit Position). For this example, though color separation is improved by implementing the single velocity limit, error in color-to-color registration is incurred at more times for a larger mean average error of 3.940 μm with a maximum error of 13.389 μm. Therefore, the stepwise position control approach as described above improves alignment within the color plane of printhead 226 with minimal error to color-to-color registration.

Figure 9:
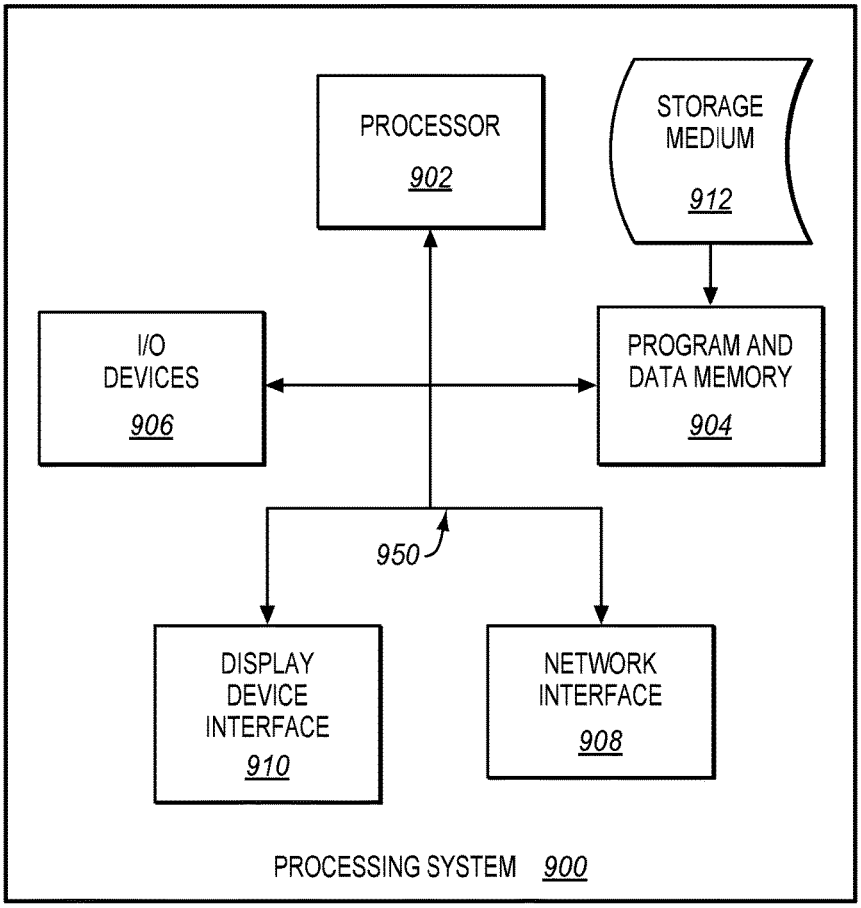
FIG. 9 illustrates a processing system operable to execute a computer readable medium embodying programmed instructions to perform desired functions in an exemplary embodiment.

Embodiments disclosed herein can take the form of software, hardware, firmware, or various combinations thereof. In one particular embodiment, software is used to direct a processing system of controller 230 and/or printhead position unit 450 to perform the various operations disclosed herein. FIG. 9 illustrates a processing system 900 operable to execute a computer readable medium embodying programmed instructions to perform desired functions in an exemplary embodiment. Processing system 900 is operable to perform the above operations by executing programmed instructions tangibly embodied on computer readable storage medium 912. In this regard, embodiments of the invention can take the form of a computer program accessible via computer-readable medium 912 providing program code for use by a computer or any other instruction execution system. For the purposes of this description, computer readable storage medium 912 can be anything that can contain or store the program for use by the computer.

Computer readable storage medium 912 can be an electronic, magnetic, optical, electromagnetic, infrared, or semiconductor device. Examples of computer readable storage medium 912 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 900, being suitable for storing and/or executing the program code, includes at least one processor 902 coupled to program and data memory 904 through a system bus 950. Program and data memory 904 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 906 (including but not limited to keyboards, displays, pointing devices, etc.) can be coupled either directly or through intervening I/O controllers. Network adapter interfaces 908 may also be integrated with the system to enable processing system 900 to become coupled to other data processing systems or storage devices through intervening private or public networks. Modems, cable modems, IBM Channel attachments, SCSI, Fibre Channel, and Ethernet cards are just a few of the currently available types of network or host interface adapters. Display device interface 910 may be integrated with the system to interface to one or more display devices, such as printing systems and screens for presentation of data generated by processor 902.

Although specific embodiments were described herein, the scope of the inventive concepts is not limited to those specific embodiments. The scope of the inventive concepts is defined by the following claims and any equivalents thereof.

I claim:

1. An apparatus comprising:

a controller configured to determine a distance for moving a printhead in a lateral direction to compensate for a lateral shift in a web of print media as the web travels in a continuous-forms printer in a conveyance direction;

the controller configured to determine a threshold distance for moving the printhead based on an allowable print error between nozzles of the printhead, to determine whether the distance exceeds the threshold distance, and to direct the printhead to move the threshold distance to compensate for the lateral shift if the distance exceeds the threshold distance.

2. The apparatus of claim 1 wherein:

the controller is configured to determine the threshold distance based at least in part on a length between the printhead and an upstream printhead.

3. The apparatus of claim 1 wherein:

the controller is configured to direct the printhead to move the distance to compensate for the lateral shift if the distance does not exceed the threshold distance.

4. The apparatus of claim 1 further comprising:

a continuous-forms printer.

5. A method comprising:

determining a distance for moving a printhead in a lateral direction to compensate for a lateral shift in a web of print media as the web travels in a continuous-forms printer in a conveyance direction;

determining a threshold distance for moving the printhead based on an allowable print error between nozzles of the printhead;

determining whether the distance exceeds the threshold distance; and directing the printhead to move the threshold distance to compensate for the lateral shift if the distance exceeds the threshold distance.

6. The method of claim 5 further comprising:

determining the threshold distance based at least in part on a length between the printhead and an upstream printhead.

7. The method of claim 5 further comprising:

directing the printhead to move the distance to compensate for the lateral shift if the distance does not exceed the threshold distance.

8. A non-transitory computer readable medium embodying programmed instructions which, when executed by a processor, are operable for performing a method comprising:

determining a distance for moving a printhead in a lateral direction to compensate for a lateral shift in a web of print media as the web travels in a continuous-forms printer in a conveyance direction;

determining a threshold distance for moving the printhead based on an allowable print error between nozzles of the printhead;

determining whether the distance exceeds the threshold distance; and directing the printhead to move the threshold distance to compensate for the lateral shift if the distance exceeds the threshold distance.

9. The medium of claim 8 wherein the method further comprises:

determining the threshold distance based at least in part on length between the printhead and an upstream printhead.

10. The medium of claim 8 wherein the method further comprises:

directing the printhead to move the distance to compensate for the lateral shift if the distance does not exceed the threshold distance.

* * * * *